US005861706A

United States Patent [19]

Lapatovich et al.

[11] Patent Number: 5,861,706

[45] Date of Patent: Jan. 19, 1999

[54] ELECTRODELESS HIGH INTENSITY DISCHARGE MEDICAL LAMP

[75] Inventors: Walter P. Lapatovich, Boxford; A. Bowman Budinger, Westford, both of Mass.; Harold H. Goss, Pelham, N.H.; Gerhard W. Doell, Beverly, Mass.; Scott J. Butler, North Oxford, Mass.; Fred Whitney, Salem, Mass.

[73] Assignee: Osram Sylvania Inc., Danvers, Mass.

[21] Appl. No.: 873,134

[22] Filed: Jun. 10, 1997

[51] Int. Cl.[6] ..... H01J 61/00; H05B 41/24

[52] U.S. Cl. ..... 313/113; 313/634; 313/160; 313/161; 313/637; 315/248; 315/344; 362/310

[58] Field of Search ..... 313/634, 113, 313/160, 161, 1, 637; 315/244, 348; 362/296, 310, 341

[56] References Cited

U.S. PATENT DOCUMENTS

| | | | |
|---|---|---|---|
| 5,070,277 | 12/1991 | Lapatovich et al. | 313/234 X |
| 5,113,121 | 5/1992 | Lapatovich et al. | 315/344 X |
| 5,144,206 | 9/1992 | Butlter et al. | 315/248 |
| 5,241,246 | 8/1993 | Lapatovich et al. | 315/248 |
| 5,280,217 | 1/1994 | Lapatovich et al. | 313/234 X |
| 5,339,008 | 8/1994 | Lapatovich et al. | 315/248 |
| 5,359,264 | 10/1994 | Butler et al. | 315/248 |
| 5,448,135 | 9/1995 | Simpson | 315/248 |
| 5,471,109 | 11/1995 | Gore et al. | 315/248 |
| 5,498,928 | 3/1996 | Lapatovich et al. | 315/248 |
| 5,498,937 | 3/1996 | Korber et al. | 315/344 X |
| 5,508,592 | 4/1996 | Lapatovich et al. | 315/248 |

*Primary Examiner*—Ashok Patel
*Attorney, Agent, or Firm*—William E. Meyer

[57] ABSTRACT

A light source, particularly suited for surgical and other medical illumination applications, includes an electrodeless lamp assembly, a reflector having the electrodeless lamp assembly mounted therein and high frequency power source for supplying high frequency power to the electrodeless lamp assembly. The electrodeless lamp assembly includes an electrodeless high intensity discharge lamp capsule including a light transmissive discharge envelope enclosing a discharge volume containing a mixture of starting gas and chemical dopant material excitable by high frequency power to a state of luminous emission. The luminous emission has a color rendering index greater than 85 and preferably has a color rendering index greater than 90. The luminous emission preferably has low energy in the spectral range of 800 to 1000 nanometers relative to energy in the visible spectral range. The electrodeless lamp assembly further includes at least one electric field applicator for coupling high frequency power to the lamp capsule.

36 Claims, 8 Drawing Sheets

ELECTRODELESS HIGH INTENSITY DISCHARGE MEDICAL LAMP

FIELD OF THE INVENTION

This invention relates to electrodeless high intensity discharge lamps and, more particularly, to electrodeless high intensity discharge lamps which have high color rendering index and relatively low heat output. The lamps are particularly useful as medical illuminators and, more particularly, as surgical illuminators, but are not limited to such uses.

BACKGROUND OF THE INVENTION

The need for improved medical examination and surgical lamps is driven by surgeon and operating room nurse preferences for superior illumination during modern surgical procedures, which frequently take many hours. Examples of such time-intensive procedures are limb reattachments in post trauma situations, open heart surgery and organ transplants. Shadow-free illumination of deep body cavities is required to eliminate eye strain and fatigue of the operating staff. It is also important to minimize downtime of the lamps and to simplify maintenance.

Surgeons respond in part to color characteristics of the body parts being observed. However, perceived color is influenced by the illuminating light. There is therefore a need for surgical lamps having high color rendering values. Also, surgeons must look closely at small body parts and into narrow cavities. There is therefore a need for a high level of illumination. For similar reasons, there is a need for lamps with acceptable color temperature, which can be moved and directed at will (universal burn position) and which provide shadow-free illumination of the operating zone. Long lamp life is also important.

The light source is commonly focused on the patient, thereby heating the operating area. Prolonged or high level heating of the patient can be injurious. There is therefore a need for a surgical lamp that minimizes temperature rise in the operating area, while delivering superior illumination.

A surgical lighting system has a stringent set of requirements. It must provide a high light level to the operating area with a spectral distribution and intensity that both supports the surgeon in his or her task, yet is not detrimental to the patient. There should be no dark shadows in the operating area, and the patient's tissue, organs and blood should be illuminated with the correct color. The perception of the smallest tissue features during the surgical procedure can be important. Sometimes the surgeon wants to see into deep body cavities, so light should come from many directions. Tissue desiccation can become an issue as body tissues exposed during surgery rapidly lose moisture. Consequently, the patient must not be excessively radiated with infrared energy which would dry the tissue. The radiant energy in the spectrum between 800 and 1000 nanometers should be kept to a minimum, as this is a spectral band of absorption by tissue and water, and contributes nothing to visual perception. Yet this spectral band is present in almost all conventional sources.

As shown in FIG. 8, the light from the surgical illuminator, for general surgery, should have color coordinates that fall within an area described by a five-sided polygon 400 on the 1931 CIE Chromaticity Diagram. Correlated color temperatures within this polygon range from 3500K to 6700K, but the color temperature of the surgical illuminator is nominally preferred to be at 4500K. A color rendering index (CRI) greater than 85 and preferably greater than 90 is required for this light source. In addition, the specific saturated red color rendering index (R9), which is not included in the computation of general CRI should be high, for example, above 60.

Surgical light sources should be flicker-free and have the ability to maintain their color properties for any lamp position. These requirements have been the major impediments to the introduction of electroded metal halide lamps into the surgical lighting area. Surgical illumination requires instant hot restart or operation of a backup illumination system following a short power interruption. Lamp life should be in excess of 1000 hours. Tungsten halogen lamps used in critical surgical applications usually undergo periodic preventive replacement. Surgical lamps must also be explosion-proof and free of electromagnetic interference (EMI), as the lamps operate in close proximity to explosive gases and highly sensitive electronic monitoring equipment.

In prior art surgical illuminators, a light source is placed inside a large area polygon reflector to direct light to the operating area from as large a spatial angle as possible. This has the advantage of reducing shadowing in the operating area by the surgeon's head and shoulders. Typically, a tungsten halogen lamp is used. Significant light filtering is necessary to eliminate the sizable component of infrared radiation generated by a tungsten halogen lamp. The infrared light filter also color corrects the tungsten halogen lamp by suppressing some red radiation to produce a higher color temperature. The normal color correction of tungsten halogen lamps then has a tendency to reduce the saturated red, or R9, index, which can affect viewing.

Electrodeless high intensity discharge (EHID) lamps have been described extensively in the prior art. In general, EHID lamps include an electrodeless lamp capsule containing a volatilible fill material and a starting gas. The lamp capsule is mounted in a fixture which is designed for coupling high frequency power to the lamp capsule. The high frequency power produces a light-emitting plasma discharge within the lamp capsule. Recent advances in the application of high frequency power to lamp capsules operating in the tens of watts range are disclosed in U.S. Pat. No. 5,070,277, issued Dec. 3, 1991, to Lapatovich; U.S. Pat. No. 5,113,121, issued May 12, 1992, to Lapatovich, et al.; U.S. Pat. No. 5,130,612, issued Jul. 14, 1992, to Lapatovich et al.; U.S. Pat. No. 5,144,206, issued Sep. 1, 1992, to Butler et al.; and U.S. Pat. No. 5,241,246, issued Aug. 31, 1993, to Lapatovich, et al. As a result, compact EHID lamps and associated applicators have become practical.

The above patents disclose small, cylindrical lamp capsules wherein high frequency energy is coupled to opposite ends of the lamp capsule with a 180° phase shift. The applied electric field is generally colinear with the axis of the lamp capsule and produces a substantially linear discharge within the lamp capsule. The fixture for coupling high frequency energy to the lamp capsule typically includes a planar transmission line, such as a microstrip transmission line, with electric field applicators, such as helices, cups or loops, positioned at opposite ends of the lamp capsule. The microstrip transmission line couples high frequency power to the electric field applicators with a 180° phase shift. The lamp capsule is typically positioned in a gap in the substrate of the microstrip transmission line and is spaced above the plane of the substrate by a few millimeters, so that the axis of the lamp capsule is colinear with the axes of the field applicators.

Electrodeless high intensity discharge lamps for use in automotive illumination systems are disclosed in the aforementioned U.S. Pat. Nos. 5,070,277 and 5,113,121 and in U.S. Pat. No. 5,299,100 issued Mar. 29, 1994 to Bellows et al. These systems require good light quality, reliability and long life, but are not required to provide exceptional color rendering. Consequently, the use of sodium scandium chemistry is common in EHID automotive headlamps, with general color rendering indexes of about 60–70. Thus, prior art EHID lamps have not met the requirements discussed above for surgical illumination.

Electrodeless lamps are also disclosed in U.S. Pat. No. 5,508,592 issued Apr. 16, 1996 to Lapatovich et al; U.S. Pat. No. 5,498,937 issued Mar. 12, 1996 to Korber et al; U.S. Pat. No. 5,498,928 issued Mar. 12, 1996 to Lapatovich et al; U.S. Pat. No. 5,471,109 issued Nov. 28, 1995 to Gore et al; U.S. Pat. No. 5,448,135 issued Sep. 5, 1995 to Simpson; U.S. Pat. No. 5,359,264 issued Oct. 25, 1994 to Butler et al; U.S. Pat. No. 5,339,008 issued Aug. 16, 1994 to Lapatovich et al; and U.S. Pat. No. 5,280,217 issued Jan. 18, 1994 to Lapatovich et al.

SUMMARY OF THE INVENTION

According to a first aspect of the invention, a lamp comprises an electrodeless lamp assembly, a reflector having the electrodeless lamp assembly mounted therein and a high frequency power source for supplying high frequency power to the electrodeless lamp assembly. The electrodeless lamp assembly comprises an electrodeless high intensity discharge lamp capsule including a light-transmissive discharge envelope enclosing a discharge volume containing a mixture of starting gas and chemical dopant material excitable by high frequency power to a state of luminous emission. The luminous emission has a color rendering index greater than 85 and preferably has a color rendering index greater than 90. The electrodeless lamp assembly further includes at least one electric field applicator for coupling high frequency power to the lamp capsule. The reflector directs light emitted by the lamp capsule in a desired distribution pattern. The lamp may be used as a medical lamp and, more particularly, as a surgical lamp.

The luminous emission from the lamp capsule preferably has low energy in the near infrared spectral range and in the ultraviolet spectral range relative to energy in the visible spectral range. Preferably, the luminous emission from the lamp capsule has a saturated red color rendering index above 60 and has a color temperature in a range of about 3300K to 4300K. One suitable chemical dopant material includes dysprosium iodide, thallium iodide and cesium iodide, and further includes mercury. The starting gas may comprise an inert gas at a pressure of about 5 to 10 torr when the lamp is cold.

The lamp may further include a housing for mounting the reflector and the high frequency power source. The housing may include an arm for supporting the reflector and a base for supporting the arm. The high frequency power source may include a power conditioning section mounted remotely from the reflector and a high frequency section electrically connected to the power conditioning section and mounted in the reflector.

The lamp may further include a second electrodeless lamp assembly mounted in the reflector and a microwave switch responsive to interruption of power for switching the high frequency power from the first electrodeless lamp assembly to the second electrodeless lamp assembly.

According to another aspect of the invention, an electrodeless lamp assembly comprises an electrodeless high intensity discharge lamp capsule including a light-transmissive discharge envelope enclosing a discharge volume containing a mixture of starting gas and chemical dopant material excitable by high frequency power to a state of luminous emission. The luminous emission has a color rendering index greater than 85 and preferably has a color rendering index greater than 90. The lamp assembly further comprises at least one electric field applicator for coupling high frequency power to the lamp capsule.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
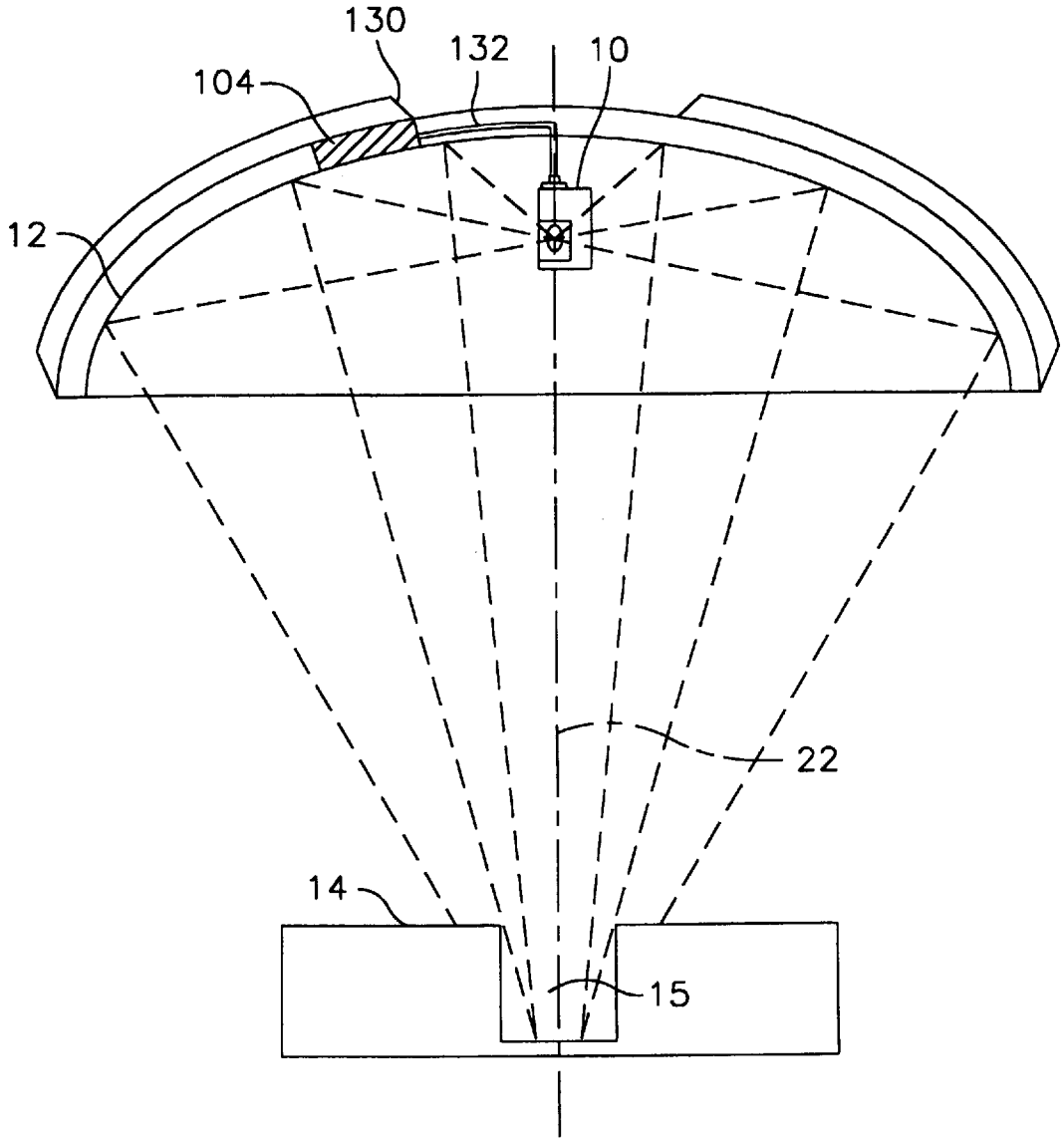
FIG. 1 is a schematic diagram showing the optical components of a surgical lamp in accordance with one embodiment of the invention.

An example of a surgical lamp in accordance with the present invention is shown schematically in FIG. 1. An electrodeless high intensity discharge lamp assembly 10 is mounted in a reflector 12. The reflector 12 may be a large area polygon reflector selected to direct light to an operating area 14 from a large spatial angle. One specific example of a suitable reflector is the reflector used in the Berchtold Chromophare D-300 Surgical Task Light. However, a variety of different reflector configurations may be utilized within the scope of the present invention. An advantage of the present invention is that an optical filter is not required to modify the spectrum or to reduce infrared radiation in the output from lamp assembly 10. Because light is directed to operating area 14 from a large spatial angle, shadowing by the surgeon is reduced and cavities, such as cavity 15, are illuminated. The lamp assembly 10 is energized by a high frequency source, a part of which is shown in FIG. 1. The lamp assembly 10 and the high frequency source are described in detail below.

Figure 2:
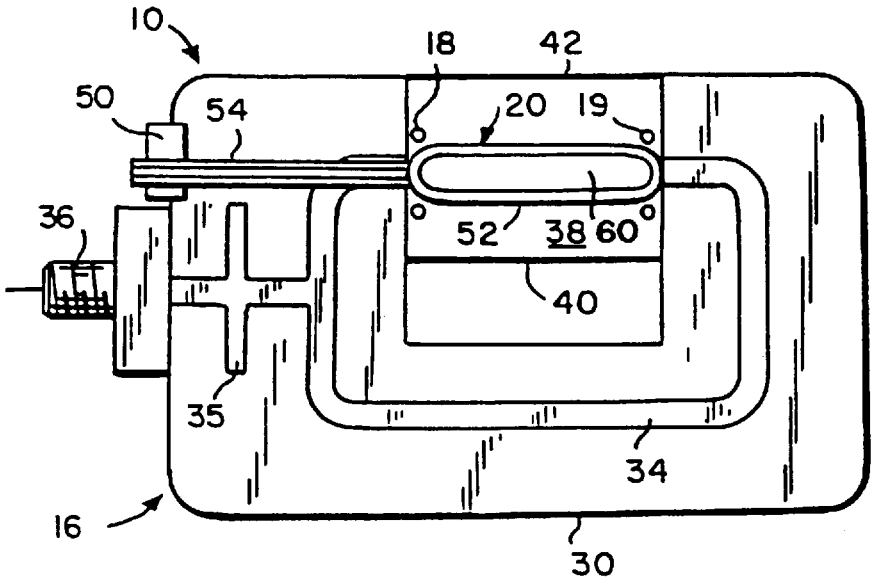
FIG. 2 is a schematic representation of an embodiment of an electrodeless high intensity discharge lamp assembly in accordance with the invention.

An example of an electrodeless high intensity discharge lamp assembly, suitable for use in the surgical lamp of FIG. 1, is shown in FIG. 2. The electrodeless lamp assembly 10 includes a planar transmission line 16, electric field applicators 18 and 19, and a lamp capsule 20 having an enclosed discharge volume containing a lamp fill material. The lamp capsule 20 contains a mixture of starting gas and chemical dopant material that is excitable by high frequency power to a state of luminous emission. The EHID lamp assembly 10 is preferably oriented in reflector 12 such that the longitudinal axis of lamp capsule 20 is parallel to optical axis 22 of reflector 12. If the reflector 12 is sufficiently large in diameter (greater than about 50 centimeters), then the electrodeless lamp assembly may be mounted transverse to the optical axis.

The planar transmission line 16 includes a substrate 30 having a patterned conductor 34 coupled to a high frequency connector 36. The connector 36 is coupled via a transmission line, such as a coaxial cable, to a high frequency source (not shown in FIG. 2). The conductor 34 interconnects the connector 36 and the electric field applicators 18 and 19. The conductor 34 is designed to provide a phase shift of 180° between applicators 18 and 19 at the frequency of the high frequency source, and may include embedded impedance matching elements such as a tuning stub 35. The opposite surface of substrate 30 is covered with a conductive ground plane (not shown). The substrate 30 is provided with a gap 38 in which the lamp capsule 20 is mounted. The lamp capsule 20 is spaced above the plane of substrate 30 and is aligned with the electric field applicators 18 and 19. Electrically conductive wires 40 and 42 may be connected between opposite sides of gap 38 to symmetrize the electric field in the region of lamp capsule 20.

The lamp capsule 20 is mechanically supported above the surface of substrate 30 by a support block 50. Lamp capsule 20 includes a discharge envelope 52 and a lamp stem 54 that extends from one end of the discharge envelope 52. The lamp stem 54 is cemented to support block 50, so that the lamp capsule 20 is spaced above substrate 30 in alignment with electric field applicators 18 and 19.

The discharge envelope 52 of lamp capsule 20 encloses a sealed discharge volume 60 which contains a mixture of a volatilizable fill material and a low pressure inert starting gas, such as argon, krypton, xenon or nitrogen, in a pressure range of 1 to 100 torr. The volatilizable fill material, when volatilized, is partially ionized and partially excited to radiating states so that useful light is emitted by the discharge. When the lamp capsule is operating and hot, the internal pressure is between 1 and 50 atmospheres.

Figure 3:
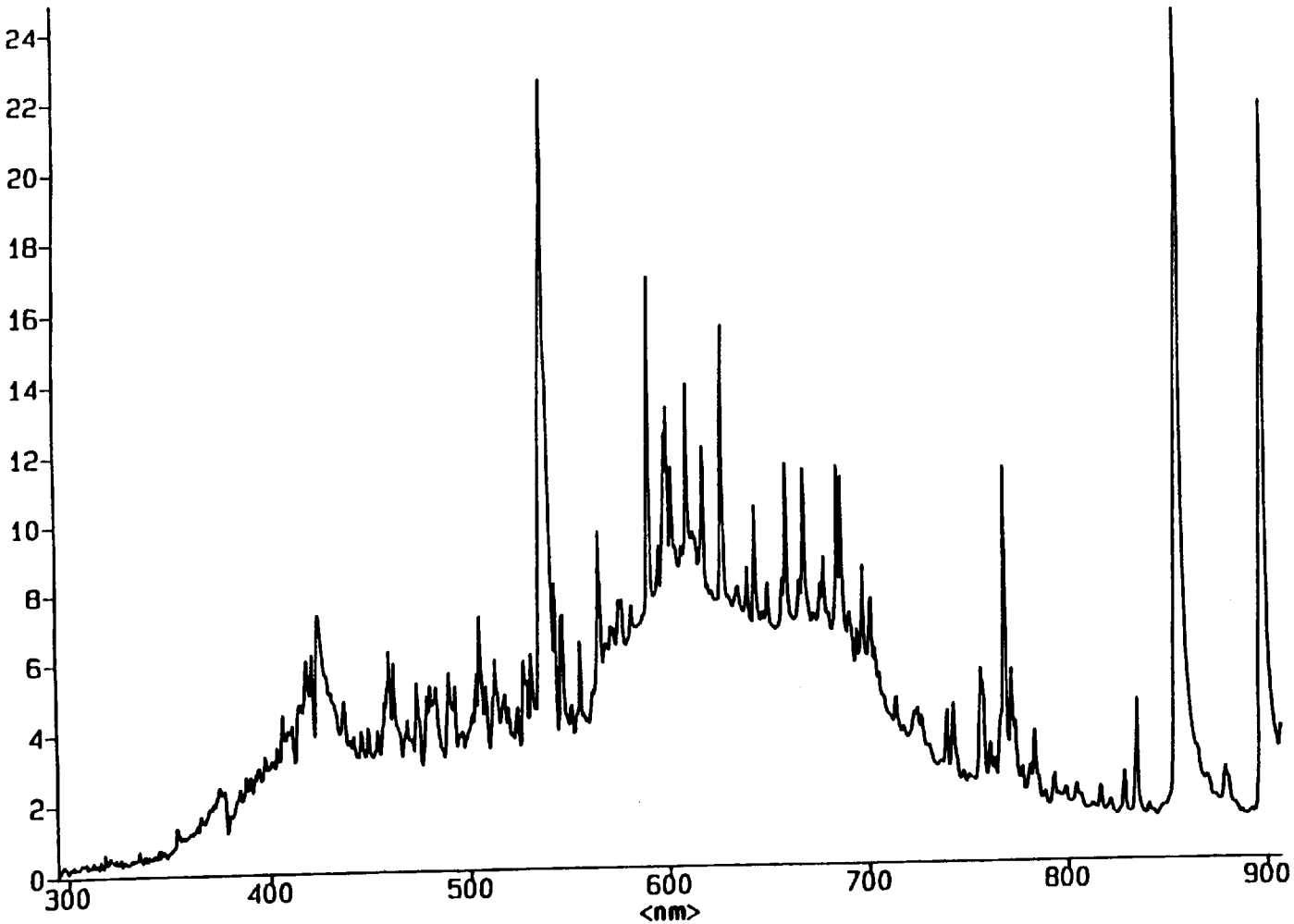
FIG. 3 is a graph of light intensity as a function of wavelength, showing the emission characteristic of an example of a surgical lamp in accordance with the invention.
Figure 8:
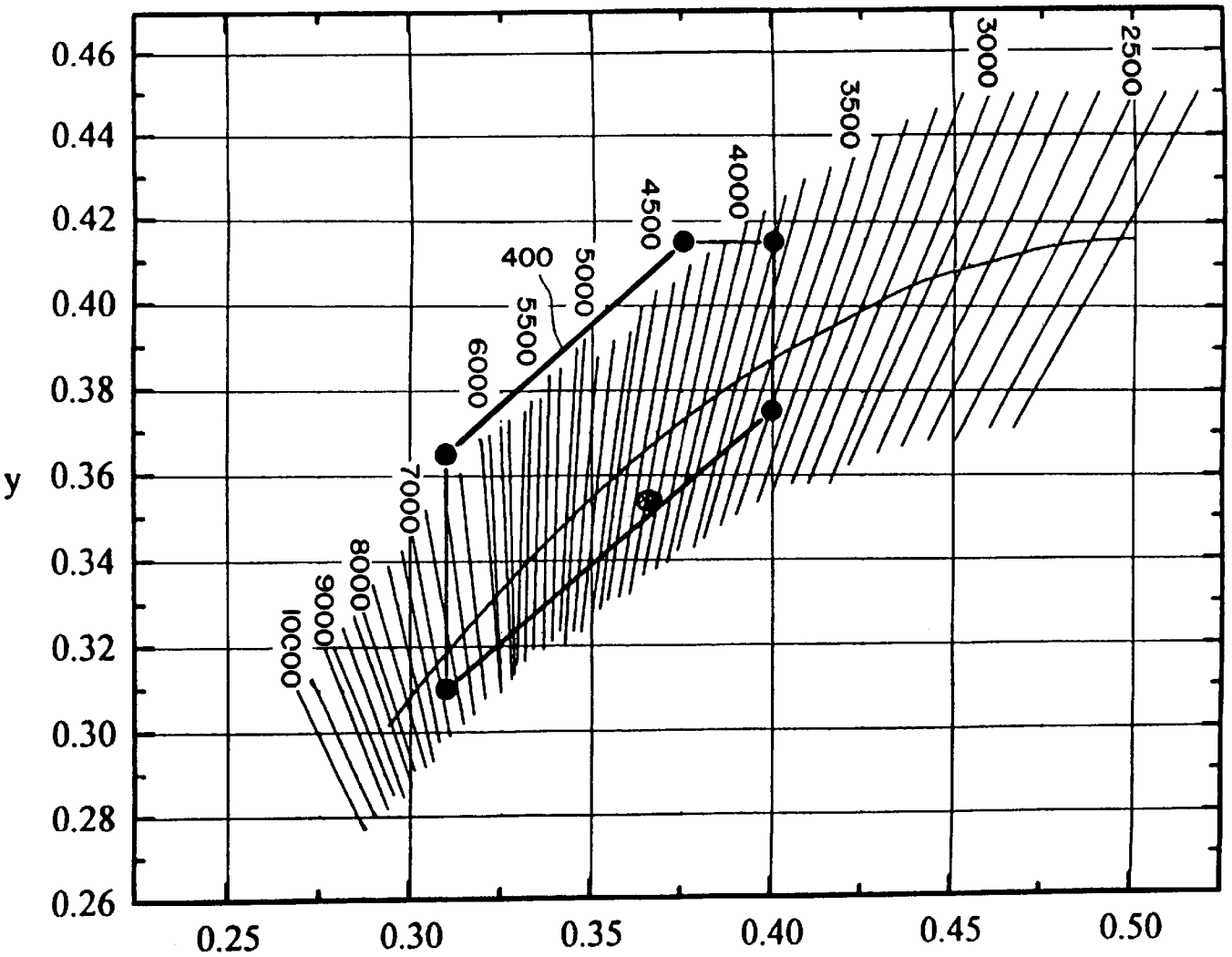
FIG. 8 is a chromaticity diagram showing acceptable chromaticity coordinates for a surgical lamp.

One of the difficulties in obtaining an acceptable EHID surgical lamp is finding a fill material that meets all the required photometric properties. The surgical lamp of the invention preferably has a color rendering index greater than 85 and more preferably has a color rendering index greater than 90. One suitable fill material is a mixture of dysprosium iodide ($DyI_3$), thallium iodide (TlI) and cesium iodide (CsI). A fill composition by weight of $DyI_3$—TlI—CsI of 74.4:15.8:9.8 has been found to provide acceptable results in a lamp capsule having an inside diameter of 2 millimeters (mm), an outside diameter of 3 mm and a length of 6 mm driven at 35 watts and 2.45 GHz. A typical spectral distribution with this fill material is shown in FIG. 3. The lamp dose was 0.1 to 0.15 milligram of salt with about 0.3 to 0.4 milligram of mercury and between 5 and 10 torr of inert gas, preferably argon, as a starting gas. Strong dysprosium lines can be seen throughout the spectrum, but particularly in the yellow-red portion of the spectrum. The underlying continuum in the blue is a result of DyI dissociation. The green thallium line at 535 nanometers dominates the spectrum. A correlated color temperature of 4261K and color coordinates of 0.3678 for x and 0.340 for y (integrating sphere measurements of a bare lamp) were obtained for this fill material. These color coordinates fall well within the acceptable chromaticity polygon 400 for surgical illuminators shown in FIG. 8. The polygon 400 is approximately defined by the x, y color coordinates (0.31, 0.31), (0.31, 0.365), (0.375, 0.415), (0.40, 0.415) and (0.40, 0.375). A color rendering index of 92 was obtained for this discharge. Other fill materials may be utilized within the scope of the present invention. Examples of other suitable fill materials include $DyI_3$—NaI—$TmI_3$—$HoI_3$:Hg—Tl and $DyI_3$-NaI-$TmI_3HoI_3$:Hg-Tl, where boldface indicates the compound having the highest weight percentage.

The output of the EHID lamp capsule of the invention preferably has low output energy in the near infrared spectral range of 800 to 1000 nanometers, and preferably has low output energy in the ultraviolet spectral range, relative to the output energy in the visible spectral range. The percentage of total light output in certain spectral bands was measured for an EHID lamp having the $DyI_3$—TlI—CsI fill composition described above. The EHID lamp provided 8% of total light output in the 295–400 nanometer band, 70% in the 400–700 nanometer band and 22% in the 700–900 nanometer band. The light output was only filtered for deep ultraviolet, i.e. below 300 nanometers.

The discharge envelope 52 is fabricated of a light-transmissive material, such as quartz, and may have a generally cylindrical shape. In one example, the discharge envelope 52 has an outside diameter of 3 mm, an inside diameter of 2 mm and a length of 6 mm. Discharge envelopes with different sizes and shapes are included within the scope of the present invention.

The electric field applicators 18 and 19 may comprise helical couplers as disclosed in the aforementioned U.S. Pat. No. 5,070,277. In alternative configurations, the electric field applicators may comprise end cup applicators as disclosed in the aforementioned U.S. Pat. No. 5,241,246; loop applicators as disclosed in the aforementioned U.S. Pat. No. 5,130,612; or any other suitable electric field applicators. In general, the electric field applicators produce a high intensity electric field within the enclosed volume of the lamp capsule, so that the applied high frequency power is absorbed by the plasma discharge.

The high intensity discharge lamp of the present invention can operate at any frequency in a range of 13 MHz to 20 GHz at which substantial power can be developed. The operating frequency is typically selected in one of the ISM bands. The frequencies centered around 915 MHz and 2.45 GHz are particularly appropriate.

The planar transmission line 16 is designed to couple high frequency power at the operating frequency to the electric field applicators 18 and 19 with 180° phase shift. The design and construction of planar transmission lines for transmission of high frequency power are well known to those skilled in the art.

Figure 4:
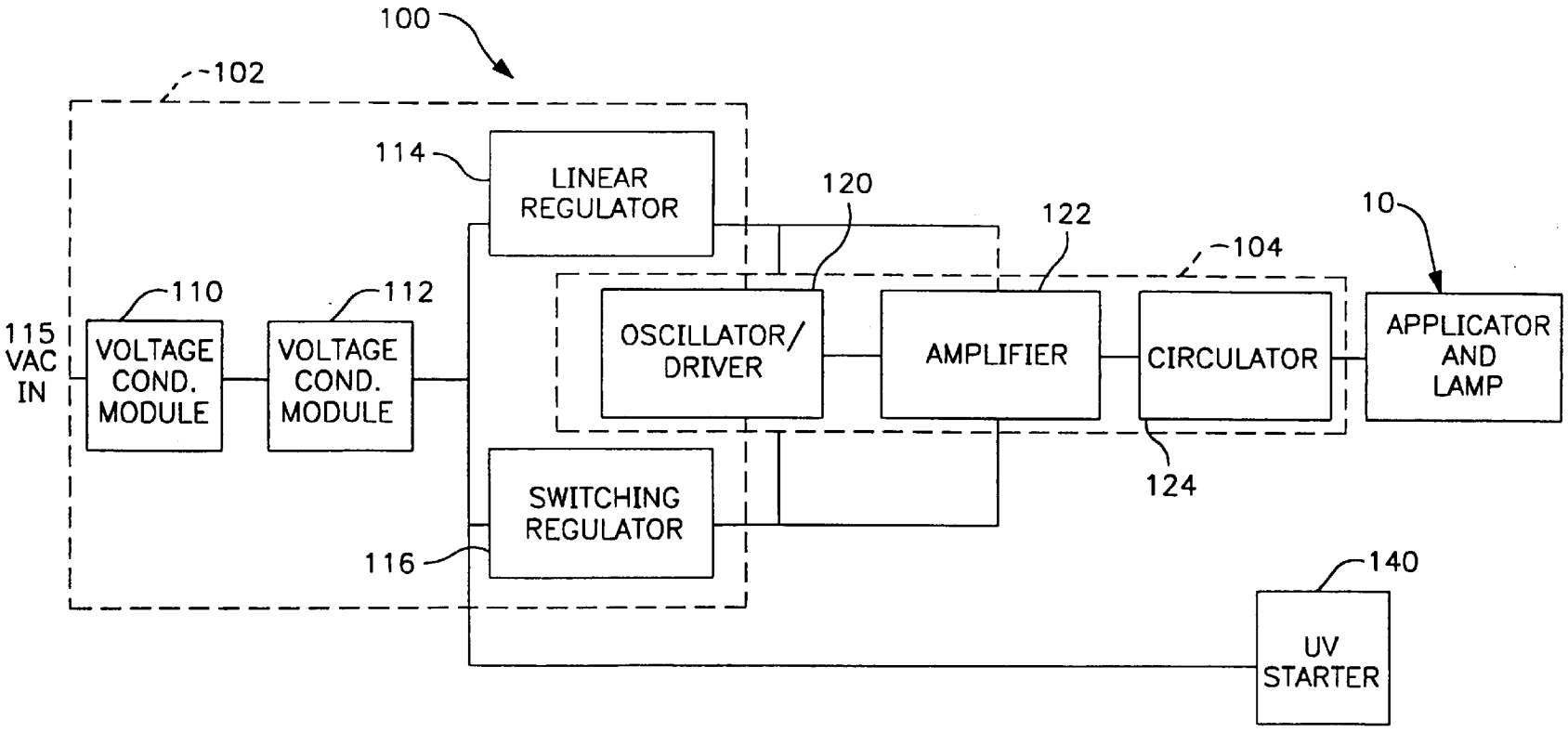
FIG. 4 is a block diagram showing electronic components of an embodiment of a lamp in accordance with the invention.

A block diagram of an example of a suitable high frequency power source for the surgical lamp is shown in FIG. 4. A high frequency source 100 includes a power conditioning section 102 and a high frequency section 104. The power conditioning section 102 includes a voltage conditioning module 110, a voltage conditioning module 112, a linear regulator 114 and a switching regulator 116. Module 110 converts input AC voltage to high voltage DC, and module 112 converts the high voltage DC to low voltage DC. The linear regulator 114 and the switching regulator 116 supply regulated DC power to high frequency section 104. The high frequency section 104 includes an oscillator/driver 120, an amplifier 122 and a circulator 124. The circulator 124 supplies high frequency power to the EHID lamp assembly 10.

In one example of the high frequency power source, the module 110 was a type VI-AIM-C1 supplied by Vicor, and the switching regulator 116 was a type UA78S40 supplied by Motorola. The linear regulator 114 was a type UC3836 supplied by Unitrode. For a nominal 115 volt input, the module 112 may be a type VI-251-CU unit supplied by Vicor, with a 1000 microfarad, 200 volt capacitor. For a nominal 220 volt input, the module 112 may be a type VI-261-CU unit supplied by Vicor, with a 560 microfarad, 400 volt capacitor. In the high frequency section, the high frequency oscillator may be a Raytheon type MX-0038, the driver, or preamplifier, may be a microwave monolithic integrated circuit preamplifier, Raytheon part number RMPA2450-20, the amplifier 122 may be a Raytheon part number G652960 and the circulator 124 may be a Trak part number 50A3001. It will be understood that different configurations of the high frequency power source may be utilized. In general, the high frequency power source is selected to provide the desired frequency and power level to the EHID lamp assembly 10. The high frequency power source should have a compact construction and high efficiency.

The power conditioning section 102 and the high frequency section 104 of power source 100 may be physically separated in the surgical lamp of the present invention. The separability of the sections of the power source permits the power conditioning section 102 to be located remotely from the high frequency section 104. Accordingly, the modules of the high frequency section 104 may be mounted in reflector 12 (FIG. 1), and the power conditioning section 102 may be located remotely from reflector 12, such as, for example, in the arm or the base of a support housing. In this approach, the size and weight of the reflector are reduced. In addition, the thermal dissipation in the reflector is reduced.

For a 35 watt EHID lamp, over 50 watts of thermal power must be dissipated in the reflector of the surgical lamp, without allowing the surface temperature of any portion of the reflector to get too hot to touch. A finned cast aluminum dome 130 (FIG. 1) may be mounted to reflector 12 to provide a highly conductive path for heat dissipation from the components of high frequency section 104, as well as a sufficient radiation area to maintain surface temperatures relatively low. The radiating area necessary to dissipate 50 watts contains approximately 200 square inches of heat dissipating fin area. As shown in FIG. 1, the high frequency section 104 may be mounted on the inside surface of dome 130 between dome 130 and reflector 12, and may be connected to EHID lamp assembly 10 by a coaxial cable 132.

The surgical lamp may also include an ultraviolet (UV) starter 140 connected to the output of module 112 and located in reflector 12 within the line of sight of lamp capsule 20. The UV starter 140 assists in initiating discharge in lamp capsule 20.

Figure 5:
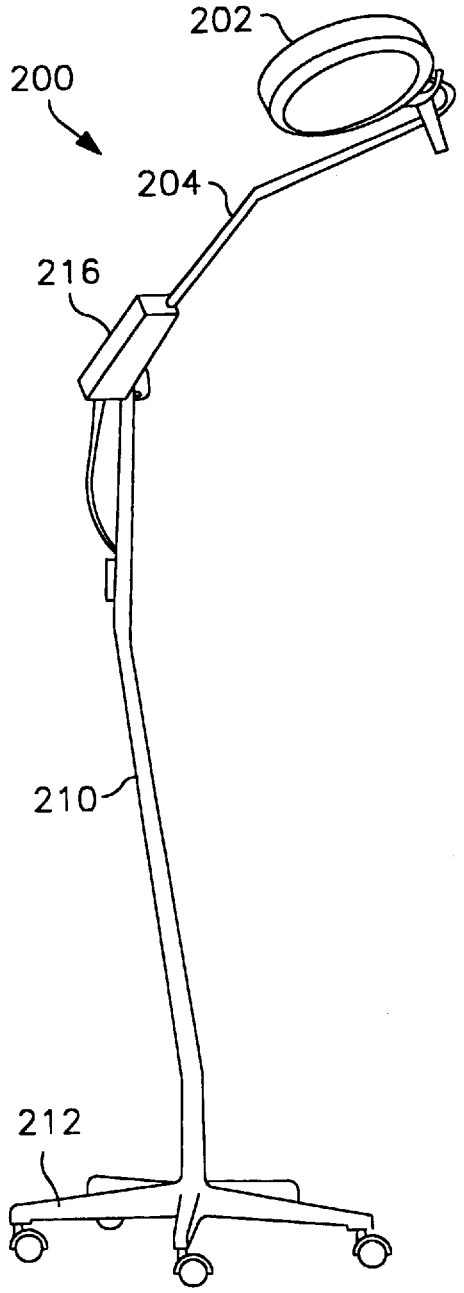
FIG. 5 illustrates an example of a surgical lamp incorporating the present invention.

An example of a surgical lamp in accordance with the invention is shown in FIG. 5. Surgical lamp 200 includes a reflector head 202 supported by an arm 204, and a stand 210 having a base 212. The arm 204 and the reflector head 202 are supported by stand 210. The reflector head 202 may be flexibly positioned relative to arm 204, and arm 204 may be flexibly positioned relative to stand 210. Reflector head 202 includes reflector 12, EHID lamp assembly 10, finned dome 130, high frequency section 104 of power source 100 and UV starter 140. The power conditioning section 102 of power source 100 may be mounted in an enclosure 216 on arm 204.

Life test data was accumulated on seven surgical EHID lamps having 2×3×6 mm discharge envelopes and the fill material described above. Some lamps showed signs of early devitrification caused by contaminants. All lamps exceeded burn times of the best conventional tungsten halogen lamps, which is about 1000 hours. This verifies the longer lamp life and hence lower maintenance of EHID surgical lamps. Linear projections based on observed data to 3500 hours and experience with such chemistries lead to predicted lifetimes of about 6000 hours. Since the lamp temperature appears to rise with time simultaneously with a slight decrease in lumen output and color degradation, the lamps are expected to ultimately degrade after about 5000 hours at a faster than linear rate. The color rendering index remained above 90 after 3500 hours.

The electrodeless high intensity discharge lamps showed minimal color changes at different orientations. Table 1 below shows a comparison of emission properties for a tungsten halogen lamp and an EHID lamp with a dysprosium fill material. The lamps were burned horizontally, vertically and at 45°. The EHID lamp is in a vertical orientation when illumination from the reflector is directed downward. The EHID lamp color coordinates, CRI and R9 (red rendering) remain almost constant with orientation. Coordinated color temperature varies somewhat, but not significantly, with angle. These measurements were made by collecting the collimated output of the reflector into an integrating chamber.

TABLE 1

| | Tungsten Halogen | | | EHID Source | | |
|---|---|---|---|---|---|---|
| | Hor. | 45° | Vert | Hor. | 45° | Vert. |
| CRI | 85 | 85 | 85 | 94 | 94 | 92 |
| R9 | 33 | 34 | 34 | 74 | 78 | 72 |
| CCT (K) | 3858 | 3831 | 3828 | 3476 | 3657 | 4261 |
| x | 0.402 | 0.403 | 0.403 | 0.399 | 0.39 | 0.368 |
| y | 0.43 | 0.431 | 0.431 | 0.371 | 0.366 | 0.361 |

Table 2 below shows a comparison between the properties of the 50 watt tungsten halogen lamp used in the Berchtold Chromophare D-300 Surgical task lamp and those for a 35 watt EHID lamp, as described above, in a similar light fixture. The EHID lamp exhibits significant improvements in maximum target illuminance, average target illuminance, total lumens delivered to the operating surface, coordinated color temperature, CRI and saturated red R9 rendering.

TABLE 2

Surgical Illuminator Performance Comparison

| Performance Characteristic | Tungsten Halogen | EHID Source |
|---|---|---|
| Max. Illuminance @ 1 Meter | 31,000 Lux | 61,500 Lux |
| Ave. Illuminance @ 1 Meter | 22,366 Lux | 46,528 Lux |
| Total Lumens @ 1 Meter | 408 | 837 |
| CCT | 3928 K | 4261 K |
| CRI | 85 | 92 |
| R9 Rendering | 34 | 72 |
| System Watts | 60 | 140 |
| System LUMENS PER WATT | 6.8 | 6 |
| Lamp Life (estimated) | 1000 Hrs | 6000 Hrs |

Figure 6:
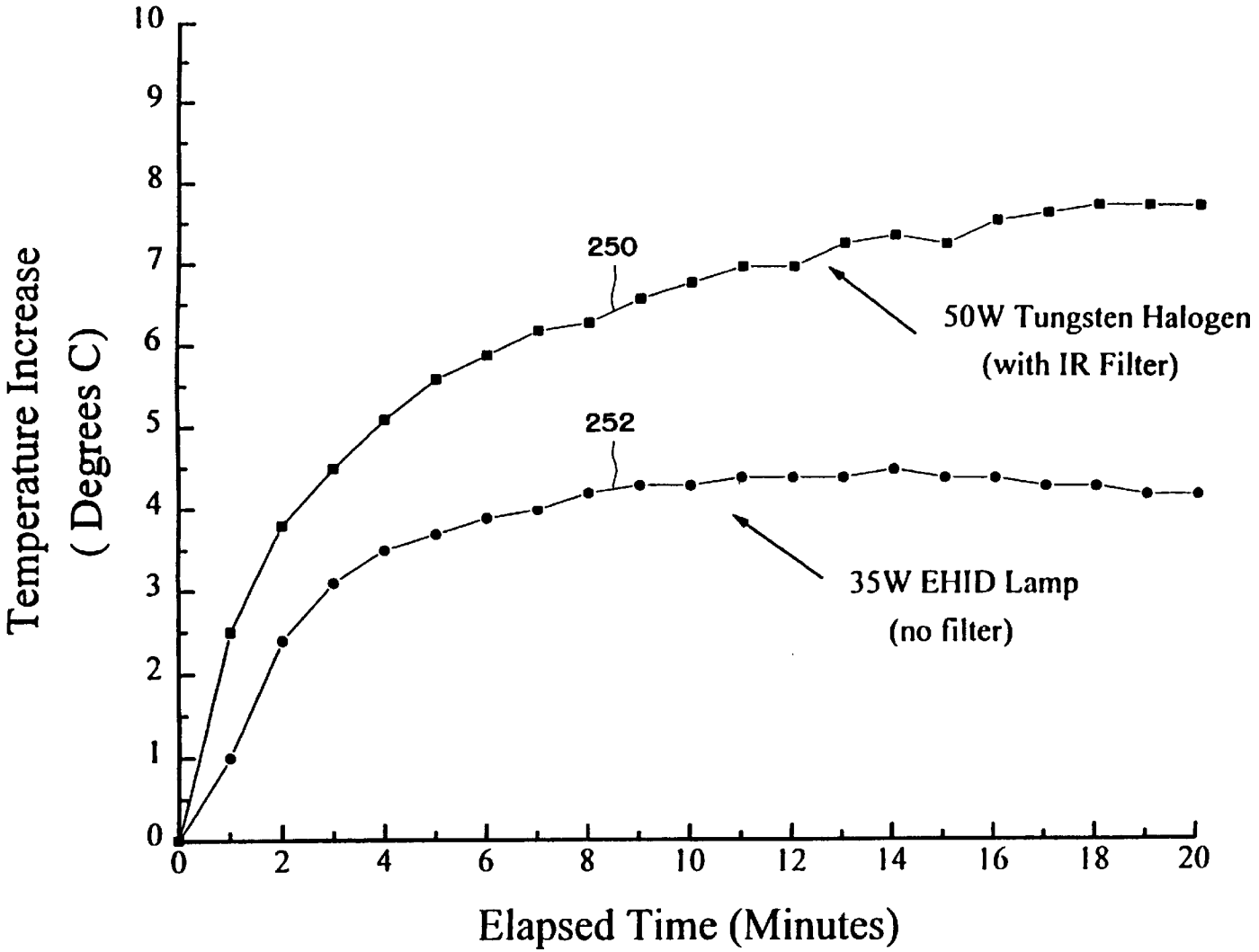
FIG. 6 is a graph of temperature increase as a function of time for a prior art surgical lamp and for an example of a surgical lamp in accordance with the present invention.

Black plate bolometer measurements were made on the beam intensities of the conventional 50 watt tungsten halogen surgical illuminator and the EHID surgical illuminator. A black plate bolometer includes a 0.5 mm thick blackened copper disk mounted in a wood frame. A thermocouple is attached to the bottom of the copper plate for temperature measurement. Measurements made with this device provide a relative indication of the total UV, visible and infrared energy incident on the measurement surface from the light source. FIG. 6 shows black plate bolometer temperature rise as a function of elapsed time after turn on for both the tungsten halogen source (with an infrared blocking filter) and the 35 watt EHID lamp described above (with no filter). Curve 250 represents the tungsten halogen lamp, and curve 252 represents the EHID lamp. Measurements were made at the beam center where peak luminance of 31,000 lux was measured for the tungsten halogen source and 61,500 lux was measured for the EHID lamp. The EHID lamp is much more efficient in delivering visible light to the operating area and produces significantly less thermal energy than the 50 watt tungsten halogen source. Tungsten halogen operating room illuminators which provide 100,000 lux peak luminance produce black plate bolometer temperature increases on the order of 15° C. The reduced heating is a unique and unanticipated benefit of the EHID surgical lamp in accordance with the invention.

A surgical lamp having single EHID lamp assembly has been shown and described hereinabove. Variations of the EHID surgical lamp of the present invention include the use of multiple EHID lamps for even more uniform illumination of the operating zone or for backup or relight purposes. For example, a cluster of EHID lamps, each with a small reflector, may be utilized in a geometric pattern in a larger head, with each lamp producing an elongated spot in the operating zone. In the case of a backup lamp, a second EHID lamp in close proximity to the first, but not located at the focus of the reflector, is energized in the event that a power interruption occurs and power is restored while the first EHID lamp is hot. While the light output is degraded somewhat since the second EHID lamp is not at the optical focus, sufficient light is delivered to the operating area to continue the procedure.

Figure 7:
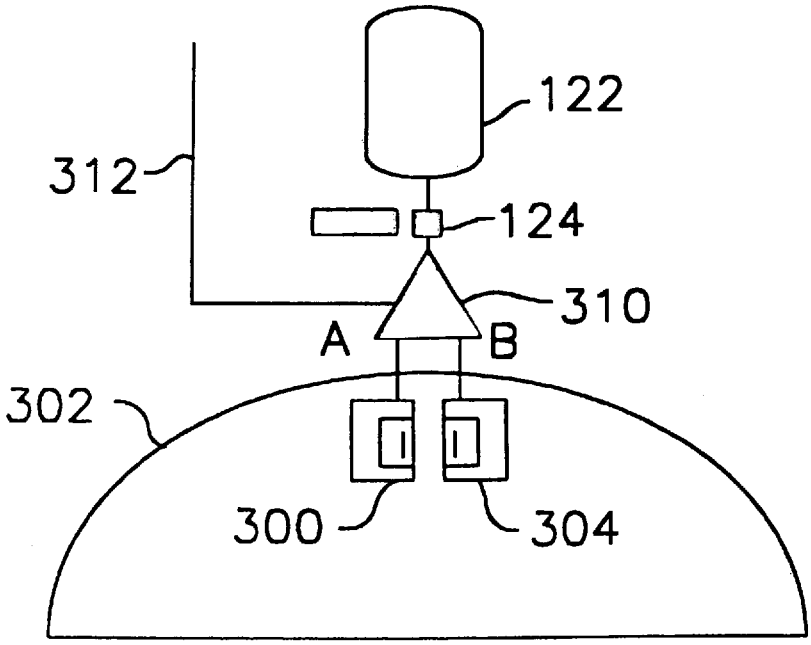
FIG. 7 is a block diagram of an example of a surgical lamp in accordance with the present invention, having primary and standby electrodeless high intensity discharge lamps.

An example of a lamp including a backup EHID lamp assembly is shown in FIG. 7. A first EHID lamp assembly 300 is located at the focus of a reflector 302. A second EHID lamp assembly 304 is located within reflector 302 but is located off the focus of reflector 302. The lamp assemblies 300 and 304 may correspond to the lamp assembly shown in FIG. 2 and described above. The lamp assemblies 300 and 304 are coupled to circulator 124 through a single pole, double throw microwave switch 310. A control line 312 of microwave switch 310 is connected to a sensing circuit, such as in power conditioning section 102, that senses power interruption. The EHID lamp assembly 300 is normally connected to circulator 124. When a brief power interruption occurs, a control signal on line 312 toggles switch 310 from lamp assembly 300 to lamp assembly 304. The lamp assembly 304 ignites, thereby avoiding interruption of illumination due to the delay in hot restarting of lamp assembly 300.

The EHID lamp described above is not limited to surgical uses, but may be used for other medical illumination applications, such as for example, medical examination. More generally, the EHID lamp may be aadapted to other environments such as street lighting, reading lamps, vehicle headlamps, recessed lighting and other lighting applications that can be met by a small lamp with high quality light and that is relatively free of heat. The ability to separate the power conditioning section of the power source from the high frequency section is advantageous. Likewise, efficiently produced high quality light with a high CRI and color temperature is a generally desirable feature. The basic EHID lamp may therefore be adapted to many different applications by changing the base, arm and/or reflector of the lamp, or by using an entirely different lamp housing.

The EHID lamp assembly described above operates at the 35 watt level. It will be understood that power modules may be combined to produce a higher wattage lamp for higher illuminance levels. For example, two modules may be combined for a 70 watt lamp to achieve illuminance levels exceeding 100,000 lux in the operating area. This lamp may be used in large operating room theaters.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A medical lamp comprising:

an electrodeless lamp assembly comprising an electrodeless high intensity discharge lamp capsule including a light-transmissive discharge envelope enclosing a discharge volume containing a mixture of starting gas and chemical dopant material excitable by high frequency power to a state of luminous emission, said luminous emission having a color rendering index greater than 85, and at least one electric field applicator for coupling said high frequency power to said lamp capsule;

a reflector, having said electrodeless lamp assembly mounted therein, for directing light emitted by said lamp capsule in a desired distribution pattern; and a high frequency power source for supplying said high frequency power to said electrodeless lamp assembly.

2. A medical lamp as defined in claim 1 wherein the luminous emission from said lamp capsule has a color rendering index greater than 90.

3. A medical lamp as defined in claim 1 wherein the luminous emission from said lamp capsule has a saturated red color rendering index above 60.

4. A medical lamp as defined in claim 1 wherein the luminous emission from said lamp capsule has a color temperature in a range of about 3300K to 4300K.

5. A medical lamp as defined in claim 1 wherein the luminous emission from said lamp capsule has a color coordinate within a region bounded by the points (0.31, 0.31), (0.31, 0.365), (0.375, 0.415), (0.40, 0.415) and (0.40, 0.375).

6. A medical lamp as defined in claim 1 which produces an average illuminance at one meter greater than 40,000 lux.

7. A medical lamp as defined in claim 2 wherein said chemical dopant material includes dysprosium iodide.

8. A medical lamp as defined in claim 7 wherein said chemical dopant material further includes thallium iodide.

9. A medical lamp as defined in claim 8 wherein said chemical dopant material further includes cesium iodide.

10. A medical lamp as defined in claim 9 wherein the weight percents of said dysprosium iodide, thallium iodide and cesium iodide are about 74.4:15.8:9.8.

11. A medical lamp as defined in claim 9 wherein said chemical dopant material further includes mercury.

12. A medical lamp as defined in claim 11 wherein said starting gas comprises argon at a pressure of about 5–10 torr when the lamp capsule is cold.

13. A medical lamp as defined in claim 1 wherein the luminous emission from said lamp capsule has low energy in the near infrared spectral range relative to energy in the visible spectral range.

14. A medical lamp as defined in claim 1 wherein the luminous emission from said lamp capsule has low energy in the ultraviolet spectral range relative to energy in the visible spectral range.

15. A medical lamp as defined in claim 1 wherein the luminous emission from said lamp capsule is substantially flicker-free.

16. A medical lamp as defined in claim 1 wherein the luminous emission from said lamp capsule is substantially independent of the orientation of said electrodeless lamp assembly.

17. A medical lamp as defined in claim 1 further including a housing for mounting said reflector and said high frequency power source.

18. A medical lamp as defined in claim 17 wherein said housing includes an arm for supporting said reflector and a base for supporting said arm.

19. A medical lamp as defined in claim 18 wherein said high frequency power source includes a power conditioning section mounted remotely from said reflector and a high frequency section electrically connected to said power conditioning section and mounted in said reflector.

20. A medical lamp as defined in claim 19 wherein said high frequency section includes an oscillator/driver, an amplifier and a circulator.

21. A medical lamp as defined in claim 19 wherein said high frequency section has a power output in the range of about 10 to 100 watts.

22. A medical lamp as defined in claim 19 further including an ultraviolet starter positioned in said reflector for initiating discharge in said lamp capsule.

23. A medical lamp as defined in claim 19 wherein a rear surface of said reflector is provided with heat dissipating fins.

24. A medical lamp as defined in claim 1 wherein a desired luminous emission of said lamp capsule is obtained without requiring an optical filter.

25. A medical lamp as defined in claim 1 further including a second electrodeless lamp assembly mounted in said reflector and a microwave switch responsive to interruption of power for switching said high frequency power from said first electrodeless lamp assembly to said second electrodeless lamp assembly.

26. An electrodeless lamp assembly comprising:

an electrodeless high intensity discharge lamp capsule including a light-transmissive discharge envelope enclosing a discharge volume containing a mixture of starting gas and chemical dopant material excitable by high frequency power to a state of luminous emission said luminous emission having a color rendering index greater than 85; and at least one electric field applicator for coupling said high frequency power to said lamp capsule.

27. An electrodeless lamp assembly as defined in claim 26 wherein the luminous emission from said lamp capsule has a color rendering index greater than 90.

28. An electrodeless lamp assembly as defined in claim 26 wherein the luminous emission from said lamp capsule has a saturated red color rendering index above 60.

29. An electrodeless lamp assembly as defined in claim 26 wherein the luminous emission from said lamp capsule has a color temperature in a range of about 3300K to 4300K.

30. An electrodeless lamp assembly as defined in claim 27 wherein said chemical dopant material includes dysprosium iodide, thallium iodide and cesium iodide.

31. An electrodeless lamp assembly as defined in claim 30 wherein the weight percents of said dysprosium iodide, thallium iodide and cesium iodide are about 74.4:15.8:9.8.

32. An electrodeless lamp assembly as defined in claim 26 wherein the luminous emission from said lamp capsule has low energy in the ultraviolet spectral range and low energy in the spectral range of 800 to 1000 nanometers relative to energy in the visible spectral range.

33. A surgical lamp comprising:

an electrodeless lamp assembly comprising an electrodeless high intensity discharge lamp capsule including a light-transmissive discharge envelope enclosing a discharge volume containing a mixture of starting and chemical dopant material excitable by high frequency power to a state of luminous emission, said luminous emission having a color rendering index greater than 85, and at least one electric field applicator for coupling said high frequency power to said lamp capsule;

a reflector, having said electrodeless lamp assembly mounted therein, for directing light emitted by said lamp capsule in a desired distribution pattern;

a housing for supporting said reflector in a desired position for directing light toward an operating area; and a high frequency power source for supplying said high frequency power to said electrodeless lamp assembly, said high frequency power source including a high frequency section mounted in said reflector and a power conditioning section located remotely from said reflector.

34. A surgical lamp as defined in claim 33 wherein the luminous emission from said lamp capsule has a color rendering index greater than 90.

35. A light source comprising:

an electrndeless lamp assembly comprising an electrodeless high intensity discharge lamp capsule including a light-transmissive discharge envelope enclosing a discharge volume containing a mixture of starting gas and chemical dopant material excitable by high frequency power to a state of luminous emission, said luminous emission having a color rendering index greater than 85, and at least one electric field applicator for coupling said high frequency power to said lamp capsule;

a reflector, having said electrodeless lamp assembly mounted therein, for directing light emitted by said lamp capsule in a desired distribution pattern; and a high frequency power source for supplying said high frequency power to said elecfrodeless lamp assembly.

36. A light source as defined in claim 35 wherein the luminous emission from said lamp capsule has a color rendering index greater than 90.

* * * * *